US006550584B1

(12) United States Patent
Granata

(10) Patent No.: US 6,550,584 B1
(45) Date of Patent: Apr. 22, 2003

(54) VEHICLE LIFT OF THE TYPE WITH FOUR COLUMNS

(75) Inventor: Tebaldo Granata, Treglio (IT)

(73) Assignee: Snap-On Deutschland Holding GmbH, Mettmann (DE)

( * ) Notice: Subject to any disclaimer, the term of this patent is extended or adjusted under 35 U.S.C. 154(b) by 0 days.

(21) Appl. No.: 09/807,594

(22) PCT Filed: Oct. 12, 1999

(86) PCT No.: PCT/IB99/01742

§ 371 (c)(1),
(2), (4) Date: Jul. 11, 2001

(87) PCT Pub. No.: WO00/21869

PCT Pub. Date: Apr. 20, 2000

(51) Int. Cl.[7] ..... B66F 7/04
(52) U.S. Cl. ..... 187/213; 187/253
(58) Field of Search ..... 187/203, 210, 187/213, 215, 216, 219, 221, 253, 272, 274, 275, 276

(56) References Cited

U.S. PATENT DOCUMENTS

| | | | | |
|---|---|---|---|---|
| 2,139,597 A | * | 12/1938 | Martin | 187/213 |
| 3,338,334 A | * | 8/1967 | Matthews | 187/213 |
| 3,395,777 A | * | 8/1968 | Rodosta | 187/213 |
| 4,300,659 A | * | 11/1981 | Silverstrand | 187/213 |

FOREIGN PATENT DOCUMENTS

| | | | |
|---|---|---|---|
| FR | 2487803 | * | 2/1982 |

* cited by examiner

*Primary Examiner*—Eileen D. Ellis
*Assistant Examiner*—Thuy V. Tran
(74) *Attorney, Agent, or Firm*—Shook, Hardy & Bacon, LLP

(57) ABSTRACT

A description is provided of a vehicle lift (10) of the type with four columns, in which the vertical movement of the cross-beams (14) and of the runways (16) along the columns (12) is controlled by means of two pistons (18), each of which is accommodated inside a respective cross-beam (14), of which it controls the movement. The lift (10) provides considerably simplified assembly, and the possibility of replacing or displacing the runways (16).

4 Claims, 1 Drawing Sheet

VEHICLE LIFT OF THE TYPE WITH FOUR COLUMNS

The present invention relates to vehicle lifts of the type with four columns.

In known vehicle lifts with four columns, the vertical movement of the cross-beams along the columns, and thus the vertical movement of the runways which support the vehicles, is controlled by means of a single piston which is accommodated beneath one of the runways. It is thus necessary to have a series of cables and return pulleys, which result in extremely difficult and lengthy assembly of the lift. In addition, the size and arrangement of the runways is restricted, owing to the traction cables themselves, such that adaptation of the runways substantially requires re-assembly of the entire lift.

The object of the present invention is to provide a vehicle lift of the type with four columns, which permits easier assembly, and also makes it possible to make the size and arrangement of the runways independent from the assembly of the lift itself.

This problem is solved remarkably well by means of a vehicle lift having four columns. Further advantageous characteristics of this lift are indicated below.

The characteristics, objects and advantages of the present invention will become more apparent from the following description and from the attached drawings, provided with reference to a non-limiting embodiment. In the various figures.

Figure 1:
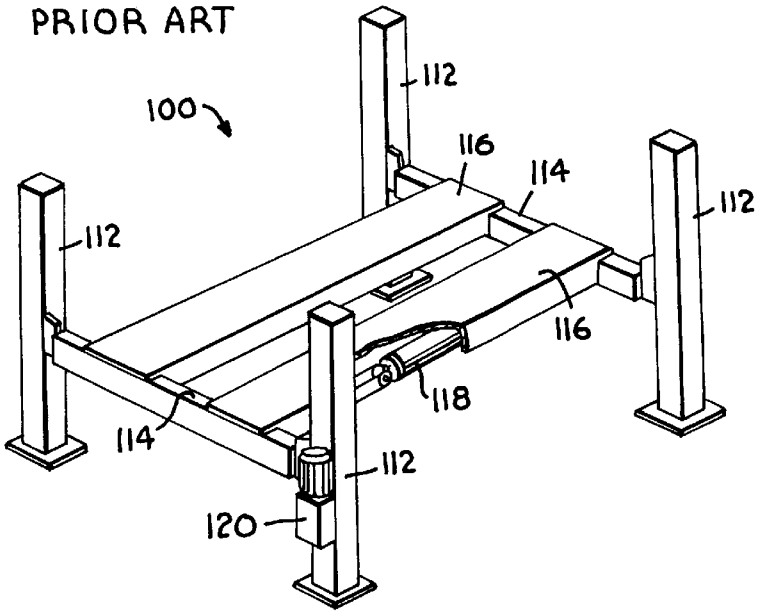
FIG. 1. PRIOR ART
FIG. 1 is a schematic perspective view of a vehicle lift with four columns according to the prior art.

With reference firstly to FIG. 1, a vehicle lift 100 with four columns, which represents the state of the art, has firstly four columns 112. Two cross-beams 114 are disposed between a respective pair of adjacent columns, and two runways 116 to support the vehicle are disposed transversely relative to the cross-beams 114. The vertical movement of the cross-beams 114 along the columns 112, and thus the vertical movement of the runways 116 which support the vehicles, is controlled by means of a single piston 118, which is actuated by corresponding actuation means 120. The piston 118 is accommodated beneath one of the runways 116.

As a result of this arrangement of the piston 118, it is necessary to have a series of cables and return pulleys, which make it possible to transform the movement of the rod of the piston 118 into a synchronous vertical movement of the cross-beams 114, and thus of the runways 116. The assembly of the lift 100 according to the known art is thus extremely difficult and lengthy, since it is necessary to pass the cables around the pulleys and along the crossbeams 114, and to adjust their length after positioning of the runways 116, or at least of the runway beneath which the piston 118 is accommodated. In addition, the runways 116 cannot be replaced or displaced without virtually having to reassemble the entire lift 100.

Figure 2:
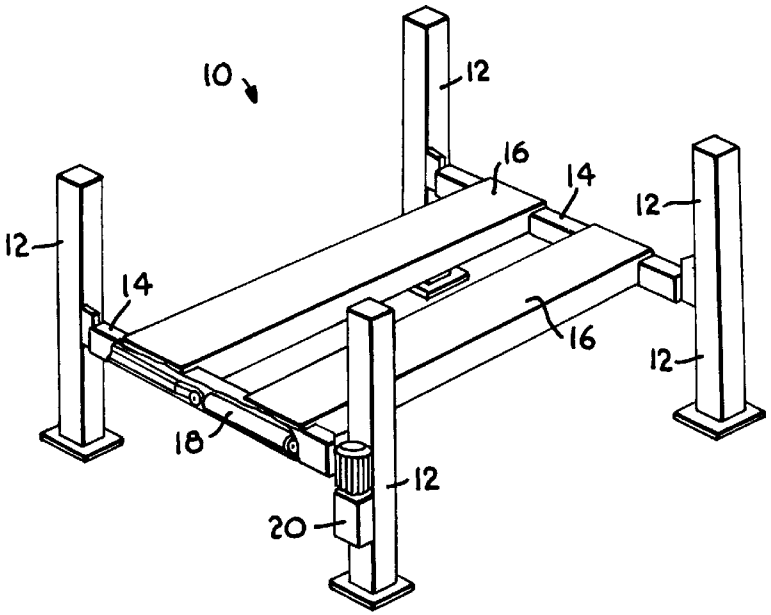
FIG. 2 is a schematic perspective view of a vehicle lift with four columns according to the present invention.

FIG. 2 illustrates a vehicle lift 10 of the type according to the present invention, with four columns. The components of the lift 10 which correspond to those of the lift 100 in FIG. 1 have corresponding reference numbers, but reduced by 100, such that a detailed description of the lift 10 is omitted for the sake of brevity. According to the invention there are provided two pistons 18 (of which only one is shown), each of which is accommodated inside a cross-beam 14.

Figure 3:
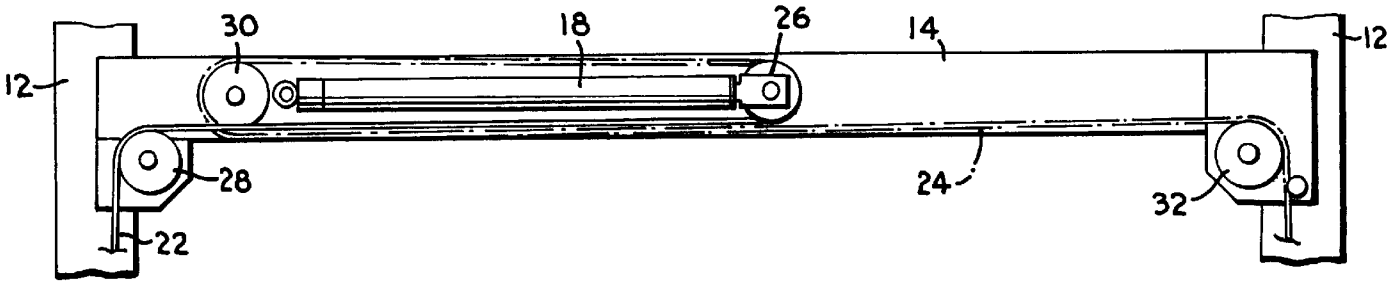
FIG. 3 is a schematic view of the system of cables and lifting pulleys in FIG. 2.

As illustrated more clearly in FIG. 3, each piston 18 controls the vertical movement of the corresponding cross-beam 14 by means of two lengths of cable 22, 24. The length of cable 22 which is drawn as an unbroken line passes around a first pulley 26, which is connected to the piston rod 18, runs along the piston 18 itself, and is deflected by 90° by a second pulley 28, and then extends along the column 12, whereas the length of cable 24 which is shown as a broken line, runs along the other side of the piston 18, passes around a third pulley 30, runs along the cross-beam 14, and is finally deflected by 90° by a fourth pulley 32, and then extends along the other column 12. It will thus be appreciated that the movement along the columns 12 is doubled in relation to the path of the piston 18. In practice, a path of approximately 90 cm is sufficient, i.e. which is reduced by half in relation to the piston 118 of the known lifts 100.

The lift 10 according to the present invention has an assembly which is considerably simplified, since the two systems of pistons, cables and pulleys for the two cross-beams 14 are independent, except that, it will be appreciated, means (not shown) must be provided for synchronisation of the movement of the two pistons 18. In addition, the assembly is altogether independent from the runways 16, which can thus easily be replaced or repositioned in order to adapt them to the type and gauge of the vehicle, such that they can also be assembled in a sliding manner along the cross-beams 14. Finally, this greater versatility provides advantages of production and storage, since the same cross-beam systems can be used for different lift models.

Persons skilled in the art will appreciate that many modifications, adaptations, completions, variants and replacements can be made to the embodiment previously described by way of non-limiting example, without departing from the scope of the invention as determined by the following attached claims.

What is claimed is:

1. A vehicle lift comprising a frame including four columns, a cross-beam disposed between each of a respective pair of adjacent columns, and two runways interconnecting said cross-beams to form the columns, cross beams and runways into an operative structure, said runways being disposed transversely relative to said cross-beams, said cross-beams being vertically movable on their respective columns, with vertical movement of the cross-beams and said runways along the columns being controlled by a piston controlled cable and pulley system, said piston being mounted on each of said cross-beams to thereby control movement of its respective cross-beam.

2. A vehicle lift according to claim 1 wherein said cable and pulley system associated with each piston comprises a first length of cable passing around a first pulley and having one end connected to the rod of the piston, said first length of cable then running along and beyond the piston to a point where it is deflected by 90° by a second pulley to extend along a first column, and a second length of cable which runs along the other side of the piston to a point where it passes around a third pulley, and thereafter runs along the cross-beam until it is deflected by 90° by a fourth pulley to extend along a second column.

3. A vehicle lift according to claim 1, further including a plurality of pairs of runways.

4. A vehicle lift according to claim 1, wherein the runways are slidably attached to said cross-beams.

* * * * *